US009874062B2

(12) United States Patent
Lajesic et al.

(10) Patent No.: US 9,874,062 B2
(45) Date of Patent: Jan. 23, 2018

(54) EXPANDABLE LATCH COUPLING ASSEMBLY

(71) Applicant: Halliburton Energy Services, Inc., Houston, TX (US)

(72) Inventors: Borisa Lajesic, Dallas, TX (US); Matthew Bradley Stokes, Keller, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 204 days.

(21) Appl. No.: 14/768,233

(22) PCT Filed: Oct. 15, 2014

(86) PCT No.: PCT/US2014/060703

§ 371 (c)(1),
(2) Date: Aug. 17, 2015

(87) PCT Pub. No.: WO2016/060657

PCT Pub. Date: Apr. 21, 2016

(65) Prior Publication Data

US 2016/0273288 A1 Sep. 22, 2016

(51) Int. Cl.

| | |
|---|---|
| ***E21B 23/02*** | (2006.01) |
| ***E21B 23/04*** | (2006.01) |
| ***E21B 43/10*** | (2006.01) |
| ***E21B 23/01*** | (2006.01) |
| ***E21B 7/06*** | (2006.01) |

(Continued)

(52) U.S. Cl.

CPC ..... *E21B 23/01* (2013.01); *E21B 7/061* (2013.01); *E21B 23/02* (2013.01); *E21B 23/04* (2013.01); *E21B 34/10* (2013.01); *E21B 43/116* (2013.01); *E21B 47/12* (2013.01);

(Continued)

(58) Field of Classification Search

CPC ..... E21B 23/02; E21B 23/04; E21B 29/08; E21B 43/103; E21B 43/105; E21B 43/106; E21B 43/108

See application file for complete search history.

(56) References Cited

U.S. PATENT DOCUMENTS

| | | | |
|---|---|---|---|
| 4,603,743 | A | 8/1986 | Lindsey, Jr. |
| 5,579,829 | A | 12/1996 | Comeau et al. |

(Continued)

OTHER PUBLICATIONS

International Search Report and Written Opinion for PCT/US2014/060703 dated Jul. 6, 2015.

*Primary Examiner* — Cathleen R Hutchins
(74) *Attorney, Agent, or Firm* — McDermott Will & Emery LLP

(57) ABSTRACT

An example latch coupling assembly includes a latch coupling defining an inner latch profile and an expandable sleeve coupled to the latch coupling. A latch defining an outer latch profile is mateable with the inner latch profile, and a mandrel is at least partially extendable within the expandable sleeve. An expansion cone is moveable along the mandrel between a first position, where the expansion cone is positioned within the expandable sleeve, and a second position, where the expansion cone is moved into engagement with an inner radial surface of the expandable sleeve to radially expand the expandable sleeve into engagement with a casing string and thereby secure the latch coupling within the casing string.

21 Claims, 4 Drawing Sheets

(51) Int. Cl.

| | |
|---|---|
| ***E21B 34/10*** | (2006.01) |
| ***E21B 43/116*** | (2006.01) |
| ***E21B 47/12*** | (2012.01) |
| *E21B 34/00* | (2006.01) |

(52) U.S. Cl.
CPC ... *E21B 2034/002* (2013.01); *E21B 2034/005* (2013.01); *E21B 2034/007* (2013.01)

(56) References Cited

U.S. PATENT DOCUMENTS

| | | | | |
|---|---|---|---|---|
| 6,276,690 | B1 * | 8/2001 | Gazewood | E21B 23/01 166/123 |
| 6,382,323 | B1 | 5/2002 | Gano et al. | |
| 6,808,022 | B2 | 10/2004 | Smith | |
| 6,907,935 | B2 | 6/2005 | Smith | |
| 7,000,704 | B2 | 2/2006 | Smith | |
| 7,513,313 | B2 | 4/2009 | Watson et al. | |
| 7,661,470 | B2 | 2/2010 | Doane et al. | |
| 8,261,842 | B2 | 9/2012 | Moeller | |
| 8,448,712 | B2 | 5/2013 | Moeller et al. | |
| 8,534,379 | B2 | 9/2013 | Giroux et al. | |
| 8,662,164 | B2 | 3/2014 | Watson | |
| 8,695,699 | B2 | 4/2014 | Whiddon et al. | |
| 2003/0102127 | A1 * | 6/2003 | Braddick | E21B 23/04 166/277 |
| 2006/0196678 | A1 * | 9/2006 | Connell | E21B 43/103 166/380 |
| 2009/0065196 | A1 * | 3/2009 | Holland | E21B 23/01 166/207 |
| 2009/0107675 | A1 | 4/2009 | Eriksen et al. | |
| 2010/0096142 | A1 | 4/2010 | Randazzo | |
| 2010/0155084 | A1 | 6/2010 | Watson et al. | |
| 2010/0243277 | A1 | 9/2010 | Ring | |
| 2011/0024135 | A1 * | 2/2011 | Noel | E21B 43/105 166/384 |
| 2011/0132623 | A1 | 6/2011 | Moeller | |
| 2012/0037381 | A1 | 2/2012 | Giroux et al. | |
| 2012/0097391 | A1 | 4/2012 | Whiddon | |
| 2012/0111579 | A1 | 5/2012 | Radford et al. | |
| 2013/0206426 | A1 | 8/2013 | Whiddon | |
| 2013/0333883 | A1 | 12/2013 | Ehtesham et al. | |
| 2014/0008083 | A1 | 1/2014 | Ring et al. | |
| 2014/0041881 | A1 | 2/2014 | Dirksen et al. | |

* cited by examiner

EXPANDABLE LATCH COUPLING ASSEMBLY

BACKGROUND

The present disclosure is related to equipment used in subterranean wells and, more particularly, to latch coupling assemblies and methods to position, anchor, and orient downhole tools.

In the oil and gas industry, it is often desirable to position a downhole tool or other piece of equipment at a known location within a well. For example, a whipstock is often positioned at a predetermined location within a well lined with a casing string to permit a lateral wellbore to be formed by cutting a window in the casing string and drilling the lateral wellbore through the window. A perforating gun may also be positioned at a predetermined location within a well lined with a casing string and operated to perforate the casing string at the predetermined location.

One method of positioning a downhole tool within a well is to provide an internal shoulder (e.g., a "no-go" shoulder) in the casing string at a predetermined location. A downhole tool or associated tubing string subsequently lowered into the casing string may include an external no-go shoulder able to locate and engage the internal no-go shoulder and thereby positively position the downhole tool at the predetermined location. This method, however, is not satisfactory in some situations. For instance, where operations are performed from a semi-submersible or floating rig, it may be difficult to maintain engagement of the no-go shoulders due to the tubing string rising and falling with ocean heave acting on the floating rig. Moreover, no-go shoulders are unable to provide angular orientation within a wellbore.

Another method of positioning a downhole tool within a well is to set a packer at a desired location within the well. The packer also seals against the casing string, which may be used to provide pressure isolation for the wellbore or may aid in preventing debris from falling further downhole within the wellbore. Various types of packers have been used for this purpose—permanent packers, retrievable packers, hydraulically set packers, mechanically set packers, etc. Nevertheless, each of these packers shares various disadvantages, such as encompassing complex configurations and components that are left downhole. Packers also may not be reliable in some applications and are often quite expensive.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Embodiments of the present disclosure provide a latch coupling assembly that may be used to position, anchor, and orient downhole tools in pre-existing wells. The latch coupling assemblies described herein may include a latch coupling operatively coupled to an expandable sleeve that may be expanded radially outward upon actuating an expansion cone from an initial position to an actuated position. Hydraulic fluid pressure provided to the latch coupling assembly may urge the expansion cone to move from the initial position within the expandable sleeve to the actuated position without the expandable sleeve. As the expansion cone moves between the initial and actuated positions, the expandable sleeve may be radially expanded into sealed and fixed engagement with the inner wall of a casing string, and thereby fixing the latch coupling in place at a known location within the well. A downhole tool may subsequently be introduced into the casing string and mated with the latch coupling with an appropriate latch configured to locate and engage the latch coupling. This may reduce operational and equipment costs, by requiring one fewer trip into the wellbore to set the latch coupling, and by leaving less downhole equipment in the well afterwards, as compared with conventional assemblies and methods.

Figure 1:
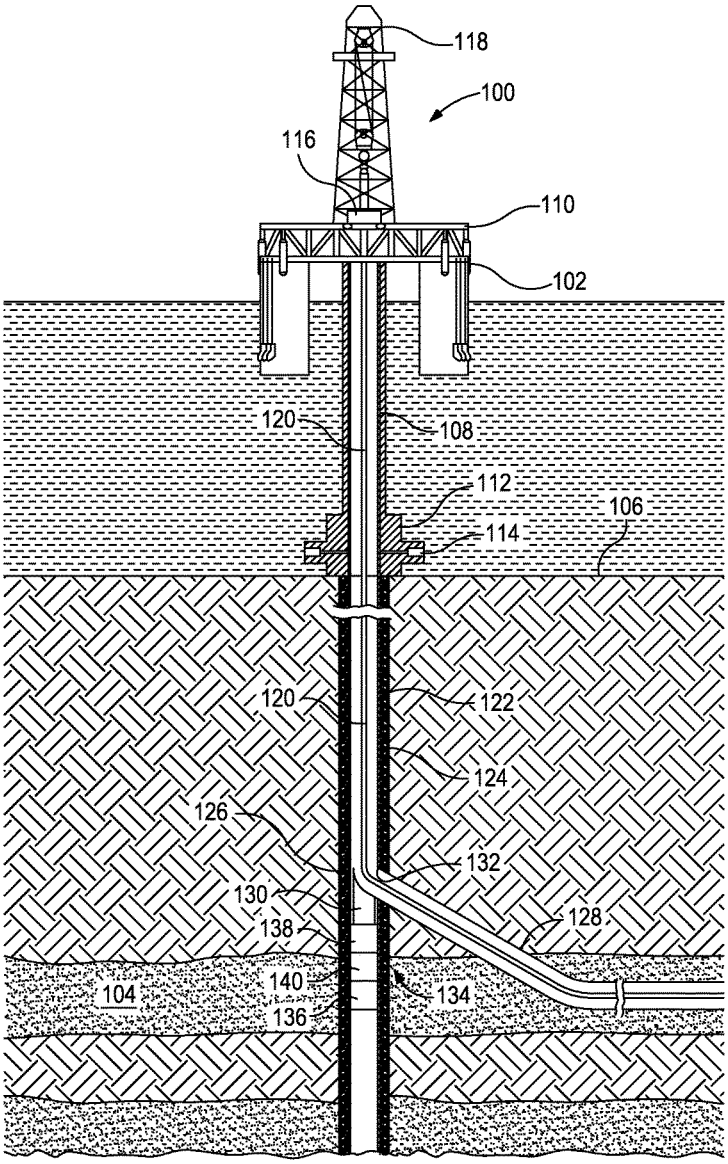
FIG. 1 is a well system that can employ the principles of the present disclosure.

Referring to FIG. 1, illustrated is a well system 100 that may employ one or more of the principles of the present disclosure, according to one or more embodiments. In one embodiment, as illustrated, the well system 100 may be or otherwise include an offshore oil and gas platform 102. It will be appreciated by those skilled in the art, however, that the principles of the present disclosure are equally well suited for use in or on other types of oil and gas rigs, such as land-based oil and gas rigs or wellhead installations. The platform 102 may be a semi-submersible platform centered over a submerged oil and gas formation 104 located below the sea floor 106. A subsea conduit 108 extends from the deck 110 of the platform 102 to a wellhead installation 112 that includes one or more blowout preventers 114. The platform 102 has a hoisting apparatus 116 and a derrick 118 for raising and lowering pipe strings, such as a drill string 120, within the subsea conduit 108.

As depicted, a main wellbore 122 has been drilled through the various earth strata below the sea floor 106, including the formation 104. A casing string 124 is at least partially cemented within the main wellbore 122. The term "casing" or "casing string" is used herein to designate a string of tubular segments or pipes used to line a wellbore. The casing string 124 may actually be of the type known to those skilled in the art as "liner" and may be a segmented liner or a continuous liner.

In some embodiments, a casing joint 126 may be interconnected between elongate portions or lengths of the casing string 124 and positioned at a desired location within the main wellbore 122 where a branch or lateral wellbore 128 is to be drilled. In other embodiments, however, the casing joint 126 may be omitted from the well system and the lateral wellbore 128 may be milled at the desired location within the main wellbore 122. A whipstock assembly 130 may be positioned within the casing string 124 at the desired location and may be configured to deflect one or more cutting tools (i.e., mills) into the inner wall of the casing string 124 (i.e., casing joint 126, if used) to mill a casing exit 132 at a desired circumferential location. The casing exit 132 provides a "window" in the casing string 124 through which one or more other cutting tools (i.e., drill bits) may be inserted in order to drill the lateral wellbore 128.

To install the whipstock 130 in the main wellbore 122 so that the lateral wellbore 128 may be drilled at the proper location and orientation, the whipstock 130 may be lowered into the main wellbore 122 on a work string (not shown). An anchor assembly 134 may be used to properly locate and orient the whipstock 130. The anchor assembly 134 may include various tools and tubular lengths interconnected in order to rotate and align the whipstock 130 (both radially and axially) to the correct exit angle orientation and axial well depth in preparation for forming the casing exit 132 and milling the lateral wellbore 128. The anchor assembly 134 may include, for example, a latch coupling assembly 136 that may have been previously installed in the main wellbore 122, as described below. The latch coupling assembly 136 may include a latch coupling (not shown) that provides an inner latch profile and a plurality of circumferential alignment elements. The latch coupling may be configured to receive a corresponding latch (not shown) operatively coupled to the whipstock 130. The anchor assembly 134 may also include an alignment bushing 138 having a longitudinal slot that is circumferentially referenced to the circumferential alignment elements of the latch coupling assembly 136. A casing alignment sub 140 may be positioned between the latch coupling assembly 136 and the alignment bushing 138 and may be used to ensure proper alignment of the latch coupling in the latch coupling assembly 136 relative to the alignment bushing 138.

It will be understood by those skilled in the art that the anchor assembly 134 may include a greater or lesser number of tools or a different set of tools that are operable to enable a determination of an offset angle between a circumferential reference element and a desired circumferential orientation of the casing exit 132. Moreover, it will be appreciated that, while the well system 100 is described herein with reference to locating setting a whipstock 130 within the main wellbore 122, several other known downhole tools may equally be set within the whipstock 130 using the latch coupling assembly 136 and its various embodiments described herein below. For example, other downhole tools that may benefit from the latch coupling assembly 136 described herein include, but are not limited to, a mill guide, a completion deflector, a logging device, a perforating gun, an isolation sleeve, and any combination thereof.

Even though FIG. 1 depicts a vertical section of the main wellbore 122, the embodiments described in the present disclosure are equally applicable for use in wellbores having other directional configurations including horizontal wellbores, deviated wellbores, slanted wellbores, combinations thereof, and the like. Use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
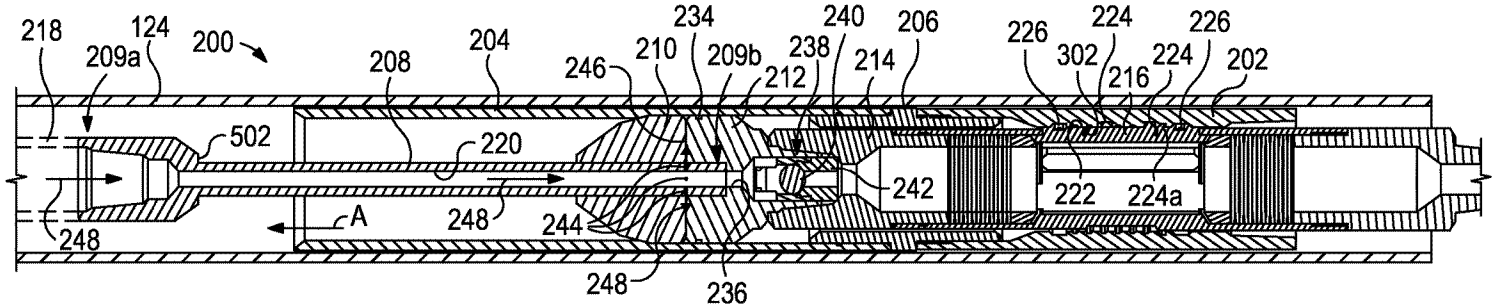
FIG. 2 depicts a cross-sectional side view of a latch coupling assembly.

Referring now to FIG. 2, illustrated is a cross-sectional side view of an exemplary latch coupling assembly 200, according to one or more embodiments. The latch coupling assembly 200 (hereafter "the assembly 200") may be the same as or similar to the latch coupling assembly 136 of FIG. 1 and, therefore, may be introduced into the casing string 124 and operable to allow a downhole tool, such as a whipstock (e.g., the whipstock 130 of FIG. 1), to be accurately located within a wellbore.

As illustrated, the assembly 200 may include a latch coupling 202 and an expandable sleeve 204 operatively coupled to the latch coupling 202. As used herein, the term "operatively coupled" refers to a physically- or mechanically-coupled engagement between at least two components and may include connection to any intermediate components that may interpose the at least two components. For instance, in some embodiments, the assembly 200 may further include an intermediate sub 206 that interposes the expandable sleeve 204 and the latch coupling 202 and otherwise serves to couple the expandable sleeve 204 to the latch coupling 202. In other embodiments, however, the intermediate sub 206 may be omitted from the assembly 200 and the expandable sleeve 204 may instead be coupled or otherwise attached directly to the latch coupling 202. In yet other embodiments, the expandable sleeve 204 may form an integral part and extension of the latch coupling 202, without departing from the scope of the present disclosure.

The term "operatively coupled" as used herein may also refer to and otherwise encompass a variety of coupling or attachment means. For example, operatively coupling two components may refer to a threaded engagement between the two components, but may also encompass a variety of other attachment means including, but not limited to, using mechanical fasteners (e.g., screws, bolts, pins, etc.), welding, brazing, adhesives, shrink fitting, or any combination thereof to couple the two components. In the illustrated embodiment, the expandable sleeve 204 may be operatively coupled to the latch coupling 202 via any of the aforementioned means, without departing from the scope of the disclosure.

Figure 3:
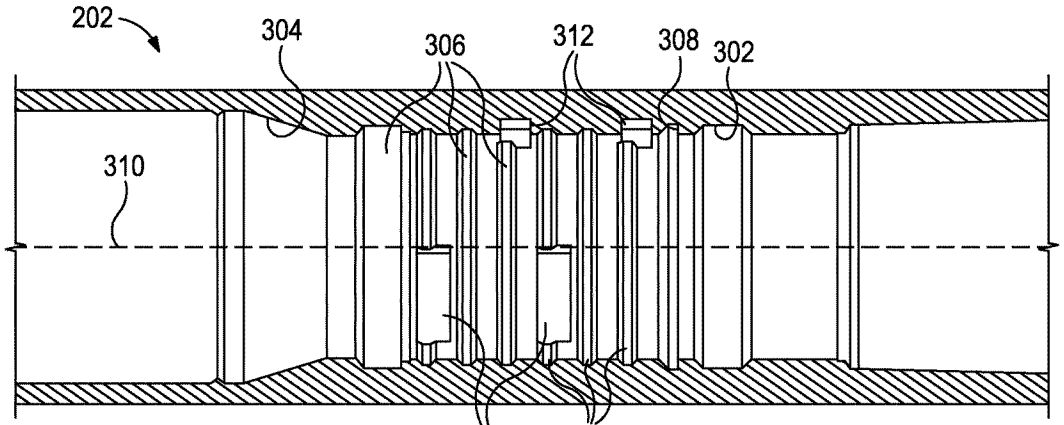
FIG. 3 depicts an enlarged cross-sectional side view of the latch coupling of FIG. 2.

Referring briefly to FIG. 3, with continued reference to FIG. 2, illustrated is an enlarged cross-sectional side view of the latch coupling 202, according to one or more embodiments. As described in more detail below, the latch coupling 202 may be adapted to engage and prevent a latch (not shown) from passing further downhole when the latch is properly engaged with the latch coupling 202. The latch coupling 202 may include an inner latch profile 302 defined on an inner radial surface 304. The inner latch profile 302 may provide one or more circumferential grooves 306, and at least one of the circumferential grooves 306 may provide a square shoulder 308 used to prevent a latch from traversing the latch coupling 202 in the downhole direction. As illustrated, the square shoulder 308 may provide a face that faces uphole or substantially uphole. More particularly, the square shoulder 308 may include a square form and the face may face orthogonal or substantially orthogonal to a longitudinal axis 310 of the latch coupling 202.

The latch coupling 202 may further include or otherwise provide one or more pockets 312 defined on the inner radial surface 304. As described in more detail below, the pockets 312 may be formed for mating engagement with one or more latch keys (not shown) of an associated latch (not shown). By way of non-limiting example, a given pocket 312 may include one or more shoulders or surfaces that are more or less radial and/or square and that are formed to engage a given latch key of the latch. Once engaged, torque may be transferred between the given pocket 312 and the given latch key, whereby rotational movement may be transferred from the latch to the latch coupling 202.

Referring again to FIG. 2, the assembly 200 may further include a mandrel 208, an expansion cone 210, an isolation sub 212, a crossover sub 214, and a latch 216. As illustrated, the assembly 200 may be introduced into the casing string 124 and otherwise run into the wellbore (e.g., the main wellbore 122 of FIG. 1) on a work string 218 extended from a surface location, such as the platform 102 of FIG. 1. The mandrel 208 may have a first end 209*a* and a second end 209*b* and may be extendable at least partially within the expandable sleeve 204. The first end 209*a* of the mandrel 208 may be operatively coupled to the work string 218, such as via a threaded engagement. The work string 218 may be any conveyance operable to convey the assembly 200 into the casing string 124 and may include, but is not limited to, drill string, production pipe, casing, coiled tubing, or any other tubular conduit. The mandrel 208 may provide and otherwise define a central flow passageway 220 that may be used to communicate a fluid to lower portions of the assembly 200 from the work string 218, as will be described in more detail below.

The latch 216 may provide an outer latch profile 222 defined on an outer radial surface and configured to locate and mate with the inner latch profile 302 of the latch coupling 202. As used herein, where two portions are capable of being mated or joined together, as with the outer latch profile and inner latch profile, they may be referred to as "mateable." The outer latch profile 222 may provide and otherwise define one or more circumferential protrusions 224 configured to mate with the circumferential grooves 306 (FIG. 3) of the latch coupling 202. At least one of the circumferential protrusions 224, shown as circumferential protrusion 224*a*, may be configured to locate and engage the square shoulder 308 (FIG. 3) of the latch coupling. Similar to the square shoulder 208, the circumferential protrusion 224*a* may include a face that provides a square form or a substantially square form. The face of the circumferential protrusion 224*a*, however, may face downhole or substantially downhole so that it is able to locate the square shoulder 208 and thereby provide an engagement that the latch 216 may be unable to push through.

The latch profile 222 may also include one or more latch keys 226 configured to locate and mate with the pockets 312 (FIG. 3) of the latch coupling 202. In some embodiments, the latch keys 226 may be spring-loaded, such as with a series of Belleville washers or other types of biasing devices (e.g., springs). The latch keys 226 may further have or otherwise exhibit beveled uphole ends. In operation, the latch keys 226 may be able to locate and seat within the pockets 312 of the latch coupling 202 and transfer torsional loads assumed by the latch 216, such as via the work string 218, to the latch coupling 202. Once the latch coupling 202 is properly set within the casing string 124, as described below, the latch 216 may be disengaged or detached from the latch coupling 202 by pulling on the work string 218 and otherwise providing an axial load on the latch 216 in the uphole direction, as shown by the arrow A. The axial load in the uphole direction A may overcome the spring force of the spring loaded latch keys 226, thereby allowing the latch keys 226 to flex or spring out of axial engagement with the pockets 312 and release the latch 216 from the latch coupling 202.

It should be understood that the inner and outer latch profiles 222, 302 of FIGS. 2 and 3, including the circumferential grooves 306 (FIG. 3), the square shoulder 308 (FIG. 3), the pockets 312 (FIG. 3), the circumferential protrusions 224 (including the circumferential protrusion 224*a*), and the latch keys 226, may exhibit a variety of designs, forms and/or configurations in various embodiments to enable mating engagement and thereby allow axial and/or rotational force transfer. Accordingly, the illustrated embodiment of the inner and outer latch profiles 222, 302 should not be considered to limit the scope of the present disclosure.

The crossover sub 214 may be operatively coupled to the latch 216 such as, for example, via a threaded engagement. The isolation sub 212 may interpose and be operatively coupled to the crossover sub 214 and the mandrel 208. In at least one embodiment, the cross-over sub 214 may be omitted from the assembly 200, and the isolation sub 212 may alternatively be coupled directly to the latch 216, without departing from the scope of the disclosure. As illustrated, the isolation sub 212 may be operatively coupled to the mandrel 208 at the second end 209*b*. As the assembly 200 is run into the casing string 124, the isolation sub 212 may be positioned within the expandable sleeve 204 and configured to sealingly engage the inner surface of the expandable sleeve 204. In at least one embodiment, the isolation sub 212 may include one or more sealing devices 234 (one shown) used to seal the interface between the isolation sub 212 and the inner radial surface of the expandable sleeve 204. The sealing device(s) 234 may be, for example, an elastomeric O-ring or the like, or any other sealing device capable of preventing fluid migration across the interface between the isolation sub 212 and the expandable sleeve 204.

The central flow passageway 220 of the mandrel 208 may be in fluid communication with an inner flow path 236 that is defined within and otherwise extending through one or more of the isolation sub 212, the crossover sub 214, and the latch 216. Accordingly, fluids introduced into the central flow passageway 220 from the work string 218 may be able to flow into the inner flow path 236.

In some embodiments, the assembly 200 may further include or otherwise provide a check valve 238 positioned within the inner flow path 236. In the illustrated embodiment, the check valve 238 is depicted as being generally positioned within a combination of the isolation sub 212 and the crossover sub 214. In other embodiments, however, the check valve 238 may be positioned entirely within one of the isolation sub 212 and the crossover sub 214, without departing from the scope of the disclosure. As illustrated, the check valve 238 may include a ball check 240 and a ball seat 242. When fluid pressure is introduced into the inner flow path 236 from the central flow passageway 220, the ball check 240 may be urged into sealing engagement with the ball seat 242, and thereby prevent fluid flow past the check valve 238 to lower (i.e., downhole) portions of the assembly 200.

It should be noted that while the check valve 238 is depicted as a ball check valve, any other type of check valve may be employed and otherwise implemented, without departing from the scope of the disclosure. For example, the ball check 240 may be replaced with a cone or any other object that may be able to sealingly engage the ball seat 242. Suitable check valves that may replace the check valve 238 as described herein may include a diaphragm or a hinged flapper valve and equally fulfill the same function. Accordingly, the check valve 238 should not be limited to the embodiment disclosed herein.

Figure 5:
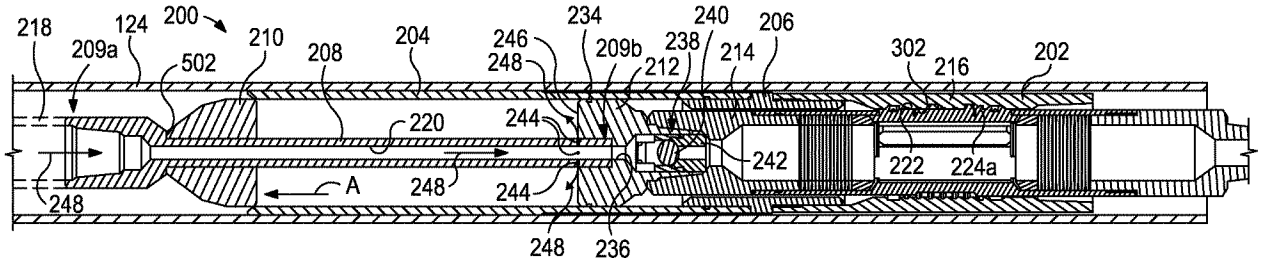
FIG. 5 depicts the assembly of FIG. 2 with the expansion cone in the actuated position.

The expansion cone 210 may be movably positioned on or about the mandrel 208. As the assembly 200 is run into the casing string 124, the expansion cone 210 may be positioned within the expandable sleeve 204. The expansion cone 210 may be configured to be moved between a first or initial position, as shown in FIG. 2, to a second or actuated position, as shown in FIG. 5 and discussed below. In the initial position, as illustrated, the expansion cone 210 may be positioned on the mandrel 208 within the expandable sleeve 204. In the actuated position, however, as illustrated in FIG. 5, the expansion cone 210 may be moved on the mandrel 208 and otherwise positioned outside of the expandable sleeve 204.

In the initial position, the expansion cone 210 may be positioned axially adjacent the isolation sub 212, thereby providing or otherwise defining an axial interface 246 between the expansion cone 210 and the isolation sub 212. The mandrel 208 may define one or more radial flow ports 244 (three shown) that facilitate fluid communication between the central flow passageway 220 and the interior of the expandable sleeve 204. When the expansion cone 210 is in the initial position, the radial flow ports 244 may be configured to align with the axial interface 246 between the expansion cone 210 and the isolation sub 212. As described in greater detail below, fluid ejected from the radial flow ports 244 at the axial interface 246 may urge the expansion cone 210 away from the isolation sub 212 in the uphole direction A. As the expansion cone 210 moves in the uphole direction A from the initial position to the actuated position, the expansion cone 210 may be configured to plastically deform the expandable sleeve 204 into sealing and fixed engagement with the inner wall of the casing string 124, and thereby set the latch coupling 202 within the casing string 124.

Figure 4:
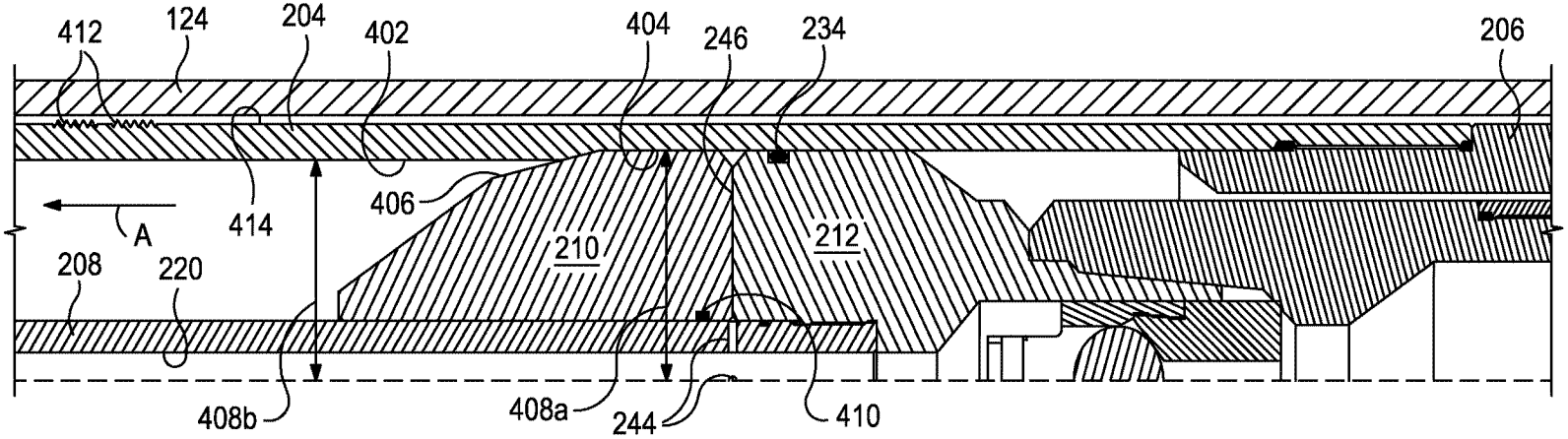
FIG. 4 is an enlarged cross-sectional side view of the expansion cone of FIG. 2 in its initial position.

More particularly, and with reference now to FIG. 4, illustrated is an enlarged cross-sectional side view of the expansion cone 210 in the initial position within the expandable sleeve 204, according to one or more embodiments. Similar numerals from FIG. 2 that are used in FIG. 4 refer to the same elements and components that will not be described again. As illustrated, the expansion cone 210 may engage or be in close proximity to an inner surface 402 of the expandable sleeve 204 when in the initial position. In some embodiments, the inner sleeve 204 may provide or otherwise define a reduced thickness portion 404 and the expansion cone 210 may engage or be in close proximity to the reduced thickness portion 404 when in the initial position.

As its name suggests, the expansion cone 210 may provide or otherwise define a generally conical or frusto-conical shape that includes a tapered surface 406, depicted in FIG. 4 as tapering downward in the uphole direction A. An outer diameter 408*a* of the expansion cone 210 may be greater than an inner diameter 408*b* of the expandable sleeve 204 uphole from the reduced thickness portion 404. As a result, as the expansion cone 210 moves in the uphole direction A, the expansion cone 210 may plastically deform the expandable sleeve 204 into sealing and fixed engagement with the casing string 124. In at least one embodiment, the expansion cone 210 may include one or more sealing devices 410 (one shown) used to seal the interface between the expansion cone 210 and the mandrel 208 as the expansion cone 210 moves between the initial and actuated positions. The sealing device(s) 410 may be, for example, and elastomeric O-ring or the like, or any other sealing device capable of preventing fluid migration across the interface between the expansion cone 210 and the mandrel 208.

The expandable sleeve 204 may be made of a variety of malleable materials that are able to expand upon being forced radially outward by the expansion cone 210. Suitable materials for the expandable sleeve 204 include, but are not limited to, metals, such as aluminum, copper, copper alloys, iron, iron alloys, and any combination thereof.

In one or more embodiments, the expandable sleeve 204 may define or otherwise provide a gripping interface 412 on its outer radial surface 414. In some embodiments, as illustrated, the gripping interface 412 may encompass a series of teeth defined in the outer radial surface 414. The teeth may be oriented or otherwise configured to resist axial loads, torsional loads, or a combination of both. As the expansion cone 210 plastically deforms the expandable sleeve 204 into engagement with the casing string 124, the teeth may be forced radially outward and into gripping engagement with the inner wall of the casing string 124 and otherwise configured to "bite" into the casing string 124 such that axial and/or rotational movement of the expandable sleeve 204 with respect to the casing string 124 is substantially prevented.

In other embodiments, however, the gripping interface 412 may comprise grit or an abrasive material applied to the outer radial surface 414 of the expandable sleeve 204 using an adhesive or any other suitable means. The abrasive material used may be generally chosen to be of a hardness greater than that of the casing string 124. Exemplary abrasive materials that could be used include, but are not limited to, carborundum (i.e., silicon carbide), flint, calcite, emery, diamond dust, novaculite, pumice dust, rouge, sand, borazon, ceramic, ceramic aluminium oxide, ceramic iron oxide, corundum (i.e., alumina or aluminium oxide), glass powder, steel abrasive, zirconia alumina, combinations thereof, and the like. Similar to the teeth, as the expansion cone 210 plastically deforms the expandable sleeve 204 into engagement with the casing string 124, the abrasive material may be forced radially inward and into gripping engagement with the inner wall of the casing string 124 such that axial and/or rotational movement of the expandable sleeve 204 with respect to the casing string 124 is substantially prevented.

Exemplary operation of the assembly 200 to set the latch coupling 202 within the casing string 124 is now provided with reference to FIGS. 2 and 5. As mentioned above, FIG. 5 depicts the assembly 200 with the expansion cone in the actuated position, according to one or more embodiments. In FIG. 2, the assembly 200 is shown in its "run-in" configuration and otherwise as being in a configuration suitable for running the assembly 200 into the casing string 124 to a desired location. As indicated above, that assembly 200 may be introduced into the casing string 124 as coupled to the work string 218 extended from a surface location, such as the platform 102 of FIG. 1. In the run-in configuration, the inner latch profile 222 of the latch coupling 202 may be engaged with the outer latch profile 302 of the latch 216, such that rotational or axial movement of the work string 218 within the casing string 124 may correspondingly move the latch coupling 202 and the expandable sleeve 204 operatively coupled to the latch coupling 202. Accordingly, the assembly 200 may be translated within the casing string 124 as a monolithic structure; where the mandrel 208, the expansion cone 210, the isolation sub 212, the crossover sub 214, and the latch 216 are all operatively coupled to the latch coupling 202, the expandable sleeve 204, and the intermediate sub 206 (if used) via the coupling engagement of the inner and outer latch profiles 222, 302.

Once the assembly 200 has reached a predetermined or desired location within the casing string 124, axial translation of the work string 218 may be stopped and a fluid 248 may be pumped to the assembly 200 via the work string 218. The fluid 248 may be conveyed into the central flow passageway 220 of the mandrel 208 from the work string 218 and subsequently flow into the inner flow path 236 from the central flow passageway 220. Once in the inner flow path 236, the fluid 248 may reach the check valve 238 and impinge upon the ball check 240, thereby urging the ball check 240 into sealing engagement with the ball seat 242.

With the ball check 240 in sealing engagement with the ball seat 242, the fluid 248 may be prevented from flowing past the check valve 238 to lower portions of the assembly 200. Instead, the fluid 248 may be diverted to the radial flow ports 244 from the central flow passageway 220 and otherwise directed into the interior of the expandable sleeve 204 at the axial interface 246 between the expansion cone 210 and the isolation sub 212.

As the fluid 248 is ejected from the radial flow ports 244 at the axial interface 246, the hydraulic pressure at the axial interface 246 increases and urges the expansion cone 210 to separate from the isolation sub 212 in the uphole direction A while the isolation sub 212 remains stationary. As the expansion cone 210 is moved in the uphole direction A from the initial position, the expansion cone 210 may radially expand the expandable sleeve 204 into engagement with the inner wall of the casing string 124. As discussed above, since the outer diameter 408*a* (FIG. 4) of the expansion cone 210 is greater than the inner diameter 408*b* (FIG. 4) of the expandable sleeve 204, the expansion cone 210 may plastically deform the expandable sleeve 204 into sealing and fixed engagement with the casing string 124 as the expansion cone 210 moves in the uphole direction A.

In some embodiments, the expansion cone 210 may move in the uphole direction A until engaging a radial shoulder 502 defined on the mandrel 208 at or near the first end 209*a* of the mandrel 208. Once the expansion cone 210 engages the radial shoulder 502, axial translation of the expansion cone 210 may be stopped. In other embodiments, axial translation of the expansion cone 210 on the mandrel 208 may cease once the expansion cone 210 exits the expandable sleeve 204, thereby allowing the fluid 248 to be exhausted into the casing string 124 past the expansion cone 210 and otherwise removing the hydraulic force on the expansion cone 210. Exhaustion of the fluid 248 into the casing string 124 may be sensed or otherwise detected at a surface location as a pressure drop in the work string 218. Once the pressure drop is detected, a well operator may have positive indication that the expansion cone 210 has properly expanded the expandable sleeve 204 and subsequently exited the expandable sleeve 204.

Figure 6:
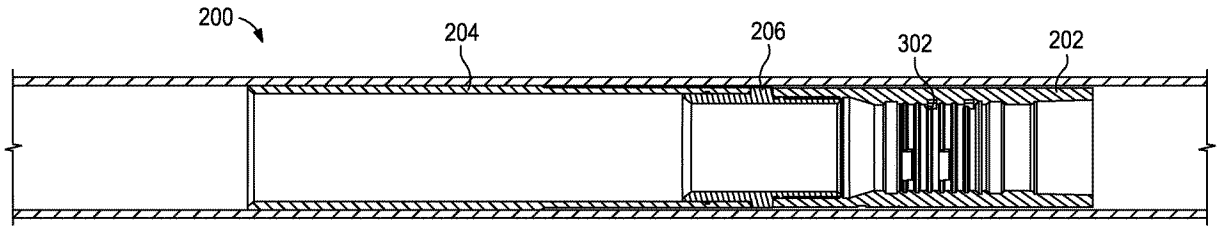
FIG. 6 depicts a cross-sectional side view of a portion of the assembly of FIG. 2 after the latch coupling has been set.

With the expandable sleeve 204 fully expanded within the casing string 124, the latch coupling 202 may be fixed in place as operatively coupled to the expandable sleeve 204. The work string 128 may then be pulled back uphole, thereby leaving only the latch coupling 202, the expandable sleeve 204, and the intermediate sub 206 (if used). This configuration is shown in FIG. 6. Pulling the work string 128 in the uphole direction A (FIGS. 2 and 5) may detach and otherwise disengage the latch 216 from the latch coupling 202, as generally described above.

Following removal of the work string 128 from the casing string 124, a downhole tool (not shown) may then be introduced into the casing string 124 to locate and mate with the latch coupling 202. More particularly, the downhole tool may include a latch (not shown) similar to the latch 216 that is configured to mate with the latch coupling 202. Upon mating the latch with the latch coupling 202, the downhole tool may be secured in a known location within the casing string 124. In some embodiments, as discussed above, the downhole tool may be a whipstock, such as the whipstock 130 of FIG. 1. In other embodiments, however, the downhole tool may be any other downhole tool required to be located at a known location within a wellbore, such as those listed and otherwise mentioned above.

Embodiments disclosed herein include:

A. A latch coupling assembly that includes a latch coupling defining an inner latch profile, an expandable sleeve operatively coupled to the latch coupling, a latch defining an outer latch profile mateable with the inner latch profile, a mandrel at least partially extendable within the expandable sleeve, and an expansion cone movably positioned on the mandrel and engageable with an inner radial surface of the expandable sleeve, wherein the expansion cone is movable between a first position, where the expansion cone is positioned within the expandable sleeve, and a second position, where the expansion cone is moved on the mandrel with respect to the expandable sleeve, and wherein moving the expansion cone from the first position to the second position radially expands the expandable sleeve into engagement with a casing string and thereby secures the latch coupling within the casing string.

B. A well system that includes a wellbore lined at least partially with a casing string, a latch coupling assembly introducible into the casing string on a work string, the latch coupling assembly including a latch coupling defining an inner latch profile, an expandable sleeve operatively coupled to the latch coupling, a latch defining an outer latch profile mateable with the inner latch profile, a mandrel having a first end coupled to the work string and being at least partially extendable within the expandable sleeve, and an expansion cone movably positioned on the mandrel and engageable with an inner radial surface of the expandable sleeve, wherein the expansion cone is movable between a first position, where the expansion cone is positioned within the expandable sleeve, and a second position, where the expansion cone is moved on the mandrel with respect to the expandable sleeve, and wherein moving the expansion cone from the first position to the second position radially expands the expandable sleeve into engagement with the casing string and thereby secures the latch coupling within the casing string.

C. A method that includes introducing a latch coupling assembly into a wellbore on a work string, the wellbore being at least partially lined with a casing string and the latch coupling assembly including a latch coupling defining an inner latch profile, an expandable sleeve operatively coupled to the latch coupling, a latch defining an outer latch profile mateable with the inner latch profile, the latch being coupled to the latch coupling at the inner and outer latch profiles, a mandrel having a first end coupled to the work string and being extended at least partially within the expandable sleeve, and an expansion cone movably positioned on the mandrel and engageable with an inner radial surface of the expandable sleeve, stopping the latch coupling assembly at a desired location within the casing string, introducing a fluid into the latch coupling assembly via the work string and thereby moving the expansion cone from a first position, where the expansion cone is positioned within the expandable sleeve, to a second position, where the expansion cone is moved on the mandrel with respect to the expandable sleeve, and radially expanding the expandable sleeve into engagement with the casing string as the expansion cone moves from the first position to the second position, and thereby securing the latch coupling within the casing string.

Each of embodiments A, B, and C may have one or more of the following additional elements in any combination: Element 1: further comprising an intermediate sub that interposes the expandable sleeve and the latch coupling and couples the expandable sleeve to the latch coupling. Element 2: wherein the inner latch profile provides one or more circumferential grooves and one or more pockets that are mateable with one or more circumferential protrusions and one or more latch keys, respectively, of the latch. Element 3: wherein at least one of the one or more circumferential grooves provides a square shoulder having a face that faces uphole, the square shoulder being mateable with at least one of the one or more circumferential protrusions that provides a square form that faces downhole. Element 4: further comprising an isolation sub operatively coupled to an end of the mandrel and positioned adjacent the expansion cone when the expansion cone is in the first position, whereby an axial interface is defined between the expansion cone and the isolation sub, a central flow passageway defined in the mandrel, and one or more radial flow ports defined in the mandrel and aligned with the axial interface, the one or more radial flow ports facilitating fluid communication between the central flow passageway and an interior of the expandable sleeve to move the expansion cone from the first position to the second position. Element 5: further comprising an inner flow path at least partially defined through the isolation sub and in fluid communication with the central flow passageway, and a check valve positioned within the inner flow path to divert fluid pressure from the central flow passageway into the axial interface via the one more radial flow ports to, and thereby move the expansion cone from the first position to the second position. Element 6: further comprising a crossover sub operatively coupled to the latch. Element 7: wherein an outer diameter of the expansion cone is greater than an inner diameter of the expandable sleeve. Element 8: further comprising a gripping interface provided on an outer radial surface of the expandable sleeve to prevent at least one of axial and rotational movement of the expandable sleeve with respect to the casing string when the expandable sleeve is radially expanded to engage the casing string. Element 9: wherein the gripping interface is at least one of a series of teeth defined in the outer radial surface and an abrasive material applied to the outer radial surface.

Element 10: wherein the latch coupling assembly further comprises an isolation sub operatively coupled to a second end of the mandrel and positioned adjacent the expansion cone when the expansion cone is in the first position, whereby an axial interface is defined between the expansion cone and the isolation sub, a central flow passageway defined in the mandrel, and one more radial flow ports defined in the mandrel and aligned with the axial interface, the one or more radial flow ports facilitating fluid communication between the central flow passageway and an interior of the expandable sleeve to move the expansion cone from the first position to the second position. Element 11: further comprising an inner flow path at least partially defined through the isolation sub and in fluid communication with the central flow passageway, and a check valve positioned within the inner flow path to divert fluid pressure from the central flow passageway into the axial interface via the one more radial flow ports, and thereby move the expansion cone from the first position to the second position. Element 12: wherein an outer diameter of the expansion cone is greater than an inner diameter of the expandable sleeve. Element 13: further comprising a gripping interface provided on an outer radial surface of the expandable sleeve to prevent at least one of axial and rotational movement of the expandable sleeve with respect to the casing string when the expandable sleeve is radially expanded to engage the casing string.

Element 14: wherein the latch coupling assembly further includes an isolation sub operatively coupled to a second end of the mandrel and positioned adjacent the expansion cone when the expansion cone is in the first position, and wherein introducing the fluid into the latch coupling assembly comprises conveying the fluid to the latch coupling assembly via the work string flowing the fluid into a central flow passageway defined in the mandrel, and ejecting the fluid out of one more radial flow ports defined in the mandrel, the one or more radial flow ports being aligned with an axial interface defined between the expansion cone and the isolation sub and facilitating fluid communication between the central flow passageway and an interior of the expandable sleeve. Element 15: further comprising hydraulically forcing the expansion cone from the first position to the second position with the fluid ejected from the one or more radial flow ports at the axial interface. Element 16: wherein an inner flow path is at least partially defined through the isolation sub and in fluid communication with the central flow passageway and a check valve is positioned within the inner flow path, and wherein ejecting the fluid out of one more radial flow ports comprises conveying the fluid into the inner flow path from the central flow passageway, actuating the check valve in response to the fluid and thereby closing off fluid flow within the inner flow path, and diverting the fluid from the inner flow path to the one or more radial flow ports. Element 17: further comprising retracting the latch coupling assembly from the casing string except for the expandable sleeve as secured to the casing string and the latch coupling operatively coupled to the expandable sleeve, introducing a downhole tool into the casing string, the downhole tool having a second latch that defines a second outer latch profile mateable with the inner latch profile, locating and mating the second latch on the latch coupling and thereby securing the downhole tool within the casing string at the desired location. Element 18: wherein the downhole tool is selected from the group consisting of a whipstock, a mill guide, a completion deflector, a logging device, a perforating gun, an isolation sleeve, and any combination thereof.

By way of non-limiting example, exemplary combinations applicable to A, B, and C include: Element 2 with Element 3; Element 4 with Element 5; Element 4 with Element 6; Element 10 and Element 11; Element 14 with Element 15; Element 14 with Element 16; and Element 17 with Element 18.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A latch coupling assembly, comprising:

a latch coupling defining an inner latch profile;

an expandable sleeve coupled to the latch coupling;

a latch defining an outer latch profile mateable with the inner latch profile;

a mandrel at least partially extendable within the expandable sleeve;

an expansion cone moveable along the mandrel between a first position, where the expansion cone is positioned within the expandable sleeve, and a second position, where the expansion cone is moved into engagement with an inner radial surface of the expandable sleeve to radially expand the expandable sleeve into engagement with a casing string and thereby secure the latch coupling within the casing string;

an isolation sub positioned adjacent the expansion cone when the expansion cone is in the first position, wherein an axial interface is defined where the expansion cone contacts the isolation sub;

a flow passageway defined in the mandrel; and one or more radial flow ports defined in the mandrel and axially aligned with the axial interface.

2. The latch coupling assembly of claim 1, further comprising an intermediate sub that interposes the expandable sleeve and the latch coupling and couples the expandable sleeve to the latch coupling.

3. The latch coupling assembly of claim 1, wherein the inner latch profile provides one or more circumferential grooves and one or more pockets that are mateable with one or more circumferential protrusions and one or more latch keys, respectively, of the latch.

4. The latch coupling assembly of claim 3, wherein at least one of the one or more circumferential grooves provides a square shoulder having a face that faces uphole, the square shoulder being mateable with at least one of the one or more circumferential protrusions that provides a square form that faces downhole.

5. The latch coupling assembly of claim 1, wherein the isolation sub is operatively coupled to an end of the mandrel, and the one or more radial flow ports facilitate fluid communication between the flow passageway and an interior of the expandable sleeve to move the expansion cone from the first position to the second position.

6. The latch coupling assembly of claim 5, further comprising:

an inner flow path at least partially defined through the isolation sub and in fluid communication with the flow passageway; and a check valve positioned within the inner flow path to divert fluid pressure from the flow passageway into the axial interface via the one more radial flow ports to, and thereby move the expansion cone from the first position to the second position.

7. The latch coupling assembly of claim 1, further comprising a crossover sub operatively coupled to the latch.

8. The latch coupling assembly of claim 1, wherein an outer diameter of the expansion cone is greater than an inner diameter of the expandable sleeve.

9. The latch coupling assembly of claim 1, further comprising a gripping interface provided on an outer radial surface of the expandable sleeve to prevent at least one of axial and rotational movement of the expandable sleeve with respect to the casing string when the expandable sleeve is radially expanded to engage the casing string.

10. The latch coupling assembly of claim 9, wherein the gripping interface is at least one of a series of teeth defined in the outer radial surface and an abrasive material applied to the outer radial surface.

11. A well system, comprising:

a wellbore lined at least partially with a casing string;

a latch coupling assembly introducible into the casing string on a work string, the latch coupling assembly including:

a latch coupling defining an inner latch profile;

an expandable sleeve coupled to the latch coupling;

a latch defining an outer latch profile mateable with the inner latch profile;

a mandrel having a first end coupled to the work string and being at least partially extendable within the expandable sleeve;

an expansion cone movable along the mandrel between a first position, where the expansion cone is positioned within the expandable sleeve, and a second position, where the expansion cone is moved into engagement with an inner radial surface of the expandable sleeve to secure the latch coupling within the casing string;

an isolation sub positioned adjacent the expansion cone when the expansion cone is in the first position, wherein an axial interface is defined where the expansion cone contacts the isolation sub;

a flow passageway defined in the mandrel; and one or more radial flow ports defined in the mandrel and axially aligned with the axial interface.

12. The well system of claim 11, wherein the isolation sub is operatively coupled to an end of the mandrel, and the one or more radial flow ports facilitate fluid communication between the flow passageway and an interior of the expandable sleeve to move the expansion cone from the first position to the second position.

13. The well system of claim 12, further comprising:

an inner flow path at least partially defined through the isolation sub and in fluid communication with the flow passageway; and a check valve positioned within the inner flow path to divert fluid pressure from the flow passageway into the axial interface via the one more radial flow ports, and thereby move the expansion cone from the first position to the second position.

14. The well system of claim 11, wherein an outer diameter of the expansion cone is greater than an inner diameter of the expandable sleeve.

15. The well system of claim 11, further comprising a gripping interface provided on an outer radial surface of the expandable sleeve to prevent at least one of axial and rotational movement of the expandable sleeve with respect to the casing string when the expandable sleeve is radially expanded to engage the casing string.

16. A method, comprising:

introducing a latch coupling assembly into a wellbore on a work string, the wellbore being at least partially lined with a casing string and the latch coupling assembly including:

a latch coupling defining an inner latch profile;

an expandable sleeve coupled to the latch coupling;

a latch defining an outer latch profile mateable with the inner latch profile, the latch being coupled to the latch coupling at the inner and outer latch profiles;

a mandrel having a first end coupled to the work string and being extended at least partially within the expandable sleeve;

an expansion cone movable along the mandrel and engageable with an inner radial surface of the expandable sleeve;

an isolation sub; and a flow passageway defined in the mandrel;

stopping the latch coupling assembly at a desired location within the casing string;

introducing a fluid into the latch coupling assembly via the work string and thereby moving the expansion cone from a first position, where the expansion cone is positioned within the expandable sleeve and adjacent the isolation sub with an axial interface defined where the expansion cone contacts the isolation sub, to a second position, where the expansion cone is moved on the mandrel with respect to the expandable sleeve, wherein the fluid is introduced via one or more radial flow ports defined in the mandrel and axially aligned with the axial interface; and radially expanding the expandable sleeve into engagement with the casing string as the expansion cone moves from the first position to the second position, and thereby securing the latch coupling within the casing string.

17. The method of claim 16, wherein the isolation sub is operatively coupled to a second end of the mandrel, and wherein introducing the fluid into the latch coupling assembly comprises:

conveying the fluid to the latch coupling assembly via the work string;

flowing the fluid into the flow passageway defined in the mandrel; and ejecting the fluid out of the one more radial flow ports defined in the mandrel, the one or more radial flow ports facilitating fluid communication between the flow passageway and an interior of the expandable sleeve.

18. The method of claim 17, further comprising hydraulically forcing the expansion cone from the first position to the second position with the fluid ejected from the one or more radial flow ports at the axial interface.

19. The method of claim 17, wherein an inner flow path is at least partially defined through the isolation sub and in fluid communication with the flow passageway and a check valve is positioned within the inner flow path, and wherein ejecting the fluid out of one more radial flow ports comprises:

conveying the fluid into the inner flow path from the flow passageway;

actuating the check valve in response to the fluid and thereby closing off fluid flow within the inner flow path; and diverting the fluid from the inner flow path to the one or more radial flow ports.

20. The method of claim 16, further comprising:

retracting the latch coupling assembly from the casing string except for the expandable sleeve as secured to the casing string and the latch coupling coupled to the expandable sleeve;

introducing a downhole tool into the casing string, the downhole tool having a second latch that defines a second outer latch profile mateable with the inner latch profile;

locating and mating the second latch on the latch coupling and thereby securing the downhole tool within the casing string at the desired location.

21. The method of claim 20, wherein the downhole tool is selected from the group consisting of a whipstock, a mill guide, a completion deflector, a logging device, a perforating gun, an isolation sleeve, and any combination thereof.

* * * * *